US010400433B2

(12) United States Patent
Mills

(10) Patent No.: US 10,400,433 B2
(45) Date of Patent: Sep. 3, 2019

(54) DRAIN CLEANING DEVICE

(71) Applicant: Boris Mills, Los Angeles, CA (US)

(72) Inventor: Boris Mills, Los Angeles, CA (US)

( * ) Notice: Subject to any disclaimer, the term of this patent is extended or adjusted under 35 U.S.C. 154(b) by 201 days.

(21) Appl. No.: 15/234,988

(22) Filed: Aug. 11, 2016

(65) Prior Publication Data

US 2017/0130443 A1 May 11, 2017

Related U.S. Application Data

(60) Provisional application No. 62/203,625, filed on Aug. 11, 2015.

(51) Int. Cl.
*E03C 1/302* (2006.01)

(52) U.S. Cl.
CPC ..... *E03C 1/302* (2013.01)

(58) Field of Classification Search
CPC ..... E03F 9/002; E03F 9/005; E03C 1/302
USPC ..... 4/255.01–255.12; D32/14; 15/104.9
See application file for complete search history.

(56) References Cited

U.S. PATENT DOCUMENTS 460,350 A * 9/1891 Cole ..... E03F 9/002 15/104.31
566,110 A * 8/1896 Wrigley ..... E03F 9/005 15/104.33
2,275,850 A * 3/1942 Gardner ..... E03F 9/002 15/104.33
3,783,457 A * 1/1974 Tornabene ..... E03D 11/00 138/89
D291,933 S * 9/1987 Weiss ..... D32/14
5,423,621 A * 6/1995 Russell ..... A46B 11/0013 15/160
5,940,897 A * 8/1999 James ..... E03C 1/308 4/255.02
5,984,100 A * 11/1999 Ramsey ..... A47K 17/00 206/361
7,752,684 B1 * 7/2010 Pieretti ..... E03C 1/308 15/105
8,745,771 B2 * 6/2014 Bates ..... E03C 1/304 4/255.04
9,631,349 B2 * 4/2017 Petner ..... E03C 1/308
2014/0298579 A1 * 10/2014 Nowak ..... E03D 9/00 4/255.11

* cited by examiner

*Primary Examiner* — Erin Deery
*Assistant Examiner* — William R Klotz
(74) *Attorney, Agent, or Firm* — Ansari Katiraei LLP; Arman Katiraei; Sadiq Ansari

(57) ABSTRACT

A drain cleaning device for cleaning and clearing a clogged drain is provided. The drain cleaning device comprises an elongated shaft having a first end and a second end. A rotator handle is secured to the first end of the elongated shaft with the rotator handle driving the elongated shaft in rotation by rotationally cranking the rotator handle. A hollow handle sheath surrounds the elongated shaft with the handle sheath allowing the elongated shaft to freely slide along a length of the handle shaft and freely rotate within the handle sheath. A resilient plunger head is mounted on an end of the handle sheath adjacent the second end of the elongated shaft. A conical terminal fitting is mounted to the second end of the elongated shaft with the conical terminal fitting movable into and out of the plunger head wherein the drain cleaning device quickly and easily clears any clogged or blocked drain.

14 Claims, 1 Drawing Sheet

DRAIN CLEANING DEVICE

CLAIM OF PRIORITY

This patent application claims priority under 35 USC 119 (e) (1) from U.S. Provisional Patent Application Ser. No. 62/203,625 filed Aug. 11, 2015, of common inventorship herewith entitled, "T Crusher," which is incorporated herein by reference as though the same were set forth in its entirety.

FIELD OF THE INVENTION

The present invention pertains to the field of plumbing tools, and more specifically to the field of drainage cleaning tools.

BACKGROUND OF THE INVENTION

Almost all households, businesses, schools, churches and healthcare facilities have one or more plungers for clearing clogged toilets. While a toilet plunger is a necessary bathroom accessory, the conventional rubber plunger is ineffective, particularly when fecal matter to be cleared is hard and compacted.

The prior art has put forth several designs for drainage cleaning tools. Among these are:

U.S. Pat. No. 6,898,807 to George Tash describes a drain plunger that snakes clogged drains at the same time the drains are being plunged. The plunger includes a pleated bellows forming a head section which is removably coupled to a handle. In one embodiment, the head and handle sections are jointly configured to release air from within the bellows while the plunger is being inserted into a basin filled with wastewater, thereby reducing or eliminating potential spillover. A flexible elongated snake disposed within the interior of the bellows enters the drain as the plunger bellows is compressed. The snake is capable of dislodging and breaking up obstructions within a drain. The snake also may have a hook at its lower end that is capable of snaring items causing obstructions within the drain. These features combine to create a plunger that provides a superior ability to effectively clear clogged drains.

U.S. Pat. No. 2,694,822 to James Murphy describes a device for cleaning pipes such as those incorporated in sewage systems, and more particularly, relates to a device especially adapted for removing objects or obstructions lodged within household drain pipes or the like. The device includes an elongated, flexible shaft having a handle at one end and having an auger projected as an axial extension of the other end of the shaft. On the other end of the shaft, a plurality of gripping tines of springable characteristics is mounted, said tines being so arranged relative to the auger as to be capable of being shifted into engagement with an object into which the auger is threaded or against which the auger abuts. On the shaft, an elongated, flexible housing is provided in which the shaft is both rotatable and longitudinally shiftable. A bell like cage is mounted upon the housing and is so arranged relative to the tines as to be adapted to cam the tines inwardly into gripping engagement with an object to be removed, responsive to relative longitudinal movement between the shaft and housing. Rotation of the shaft engages the object with the auger while longitudinal movement of the shaft relative to the housing shifts the tines into the outer surface of the object of obstruction.

U.S. Pat. No. 963,965 to Emil H. Weber describes a device comprising a shank, a gripping device comprising spring fingers and a support therein carried by the shank. The said support includes a cylinder open at one end, with a plunger projected there, and closed at its other end. There are openings in said closed end, a plunger working in the cylinder, the fingers being fastened to the plunger and projecting divergingly therefrom through the openings in the closed end of the cylinder, and means connected to the plunger for operating the same. The said means enter the cylinder through its open end and passing through the tubular shank.

None of these prior art references describe the present invention.

SUMMARY OF THE INVENTION

It is an object of the present invention to provide a superior, hand operated tool for quickly and easily clearing virtually any clogged or blocked toilet.

The present invention is a drain cleaning device for cleaning and clearing a clogged drain. The drain cleaning device comprises an elongated shaft having a first end and a second end. A rotator handle is secured to the first end of the elongated shaft with the rotator handle driving the elongated shaft in rotation by rotationally cranking the rotator handle. A hollow handle sheath surrounds the elongated shaft with the handle sheath allowing the elongated shaft to freely slide along a length of the handle shaft and freely rotate within the handle sheath. A resilient plunger head is mounted on an end of the handle sheath adjacent the second end of the elongated shaft. A conical terminal fitting is mounted to the second end of the elongated shaft with the conical terminal fitting movable into and out of the plunger head wherein the drain cleaning device quickly and easily clears any clogged or blocked drain.

In addition, the present invention includes a method for cleaning and clearing a clogged drain. The method comprises providing an elongated shaft having a first end and a second end, securing a rotator handle to the first end of the elongated shaft, surrounding the elongated shaft with a hollow handle sheath, mounting a resilient plunger head on an end of the handle sheath adjacent the second end of the elongated shaft, mounting a conical terminal fitting to the second end of the elongated shaft, rotationally cranking the rotator handle, rotating the elongated shaft and the conical terminal fitting, moving the conical terminal fitting into and out of the plunger head, and quickly and easily clearing any clogged or blocked drain.

The present invention further includes a drain cleaning device for cleaning and clearing a clogged drain. The drain cleaning device comprises an elongated shaft having a first end and a second end. A rotator handle is secured to the first end of the elongated shaft with the rotator handle driving the elongated shaft in rotation by rotationally cranking the rotator handle and the rotator handle substantially parallel to the elongated shaft. A hollow handle sheath surrounds the elongated shaft with the handle sheath allowing the elongated shaft to freely slide along a length of the handle shaft and freely rotate within the handle sheath. A resilient plunger head is mounted on an end of the handle sheath adjacent the second end of the elongated shaft. A conical terminal fitting is mounted to the second end of the elongated shaft with the conical terminal fitting movable into and out of the plunger head. A universal ball joint swivel connects the conical terminal fitting to the second end of the elongated shaft allowing the conical terminal fitting a full range of motion.

Wherein the drain cleaning device quickly and easily clears any clogged or blocked drain.

DETAILED DESCRIPTION OF THE INVENTION

Figure 2:
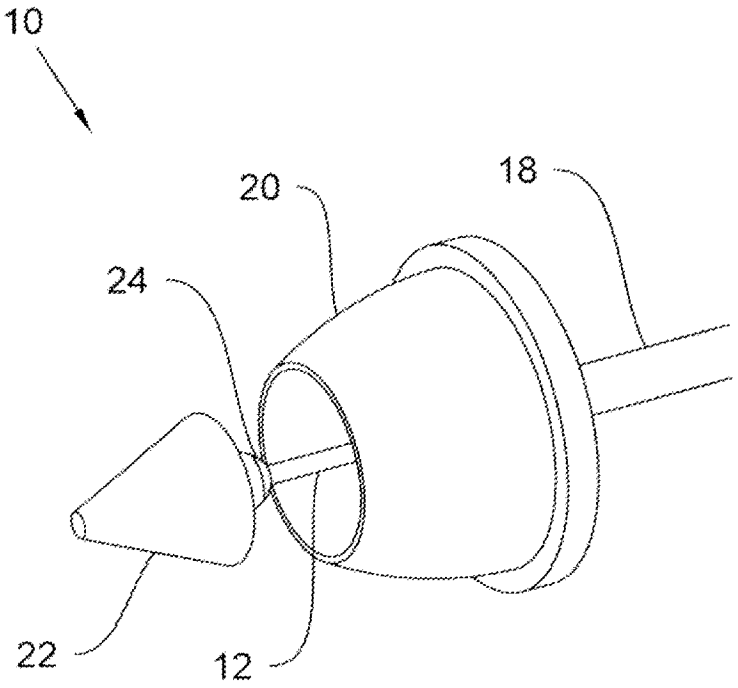
FIG. 2 is a close up perspective view illustrating the drain cleaning device, constructed in accordance with the present invention, showing the hard rubber crusher mechanism and an integrated ball joint connecting the elongated shaft to the crusher mechanism.
Figure 1:
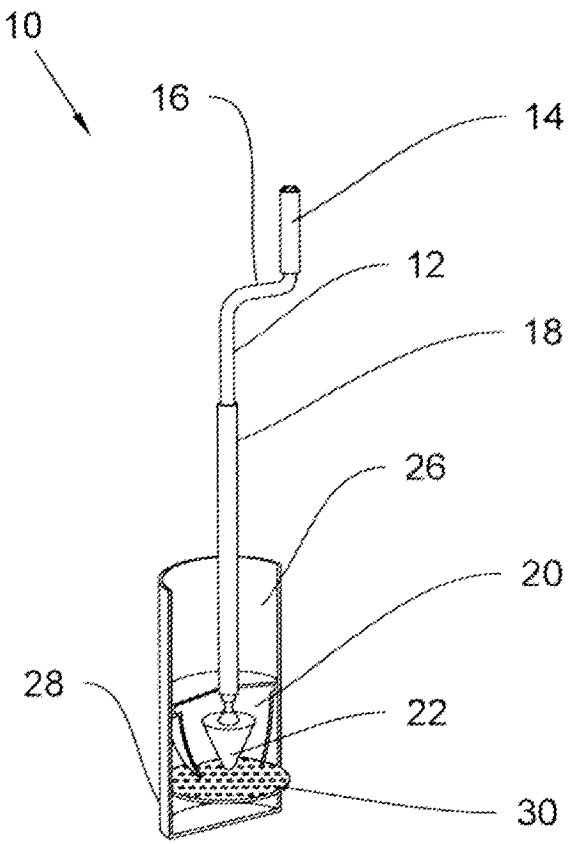
FIG. 1 is a sectional perspective view illustrating a drain cleaning device, constructed in accordance with the present invention, showing a rotator handle, an elongated shaft, a handle sheath, a crusher mechanism, a storage housing, and a drained water reservoir within the storage housing.

The present invention, hereinafter referred to as the Drain Cleaning Device, indicated generally at 10, is a superior, hand operated tool for quickly and easily clearing virtually any clogged or blocked toilet. The Drain Cleaning Device 10 is engineered for clearing a clogged toilet much better than the conventional rubber plunger. Easily operated and equipped with its own drip free holder, the Drain Cleaning Device 10 quickly, neatly and efficiently clears virtually any clogged or blocked toilet and saves householders as well as commercial and institutional entities a lot of plumbing frustration and bills.

The Drain Cleaning Device 10 of the present invention includes an elongated shaft 12 having a first end and a second end. In a preferred embodiment, the elongated shaft 12 is a full length, solid metal shaft. Also, preferably, the length of the elongated shaft 12 is approximately twenty (20") inches to approximately twenty four (24") inches although constructing the elongated shaft 12 in different lengths is within the scope of the present invention. The elongated shaft 12 of the Drain Cleaning Device 10 is preferably constructed from a hardened and durable molded thermoplastic material, a carbon fiber composite material, or a polished metal material although constructing the elongated shaft 12 from other materials is within the scope of the present invention.

In addition, the Drain Cleaning Device 10 of the present invention includes a rotator handle 14 secured to the first end of the elongated shaft 12. The rotator handle 14 drives the elongated shaft 12 in rotation by rotationally cranking the rotator handle 14. Preferably, the rotator handle 14 is substantially parallel to the elongated shaft 12 with an intermediate handle portion 16 between the first end of the elongated shaft 12 and the rotator handle 14. The intermediate handle portion 16 is preferably substantially perpendicular to the elongated shaft 12 and the rotator handle 14 such that a longitudinal axis of the elongated shaft 12 is offset from a longitudinal axis of the rotator handle 14.

Additionally, the Drain Cleaning Device 10 of the present invention includes a hollow handle sheath 18 surrounding the elongated shaft 12 allowing the elongated shaft 12 to freely slide up and down along the length of the handle sheath 18 and freely rotate within the handle sheath 18. Preferably, the handle sheath 178 extends substantially from the first end of the elongated shaft 12 to the second end of the elongated shaft 12 although having a handle sheath 18 with different lengths is within the scope of the present invention.

Furthermore, the Drain Cleaning Device 10 of the present invention includes a stiff, but pliable, resilient plunger head 20 mounted on the end of the handle sheath 18 adjacent the second end of the elongated shaft 12. Preferably, the plunger head 20 measures approximately five and one half inches in diameter at its uppermost widest point, and three inches in diameter at its bottom opening although having the plunger head 20 with different dimensions is within the scope of the present invention.

Further yet, the Drain Cleaning Device 10 of the present invention includes a conical terminal fitting 22 mounted to the second end of the elongated shaft 12 with the conical terminal fitting 22 movable into and out of the plunger head 20. The conical terminal fitting 22, known as the crusher fitting, is preferably constructed of a hard rubber material and preferably measures approximately three (3") inches in height although constructing the conical terminal fitting 22 from a different material and in different sizes is within the scope of the present invention.

In a preferred embodiment, the conical terminal fitting 22 of the Drain Cleaning Device 10 of the present invention is mounted on the second end of the elongated shaft 12 by a universal ball joint swivel 24 concealed within the plunger head 20. The universal ball joint swivel 24 allows the conical terminal fitting 22 a full range of motion in cleaning drains, as will be described in further detail below.

The Drain Cleaning Device 10 of the present invention further includes a storage housing 26 preferably constructed from a molded thermoplastic or stamped metal. Cylindrical in shape, the storage housing 26 is preferably an inch or two shorter than the Drain Cleaning Device 10 and measures approximately six (6") inches in diameter. The base of the storage housing 26 acts as a collecting reservoir 28 or pan, for moisture dripping off the conical terminal fitting 22 and the plunger head 20. When positioned in the storage housing 26, the Drain Cleaning Device 10 rests on a mesh layer 30 situated just above the collecting reservoir 28. The aforementioned storage, housing 26 conceals the Drain Cleaning Device 10 when not in use and permits the Drain Cleaning Device 10 to drain and dry after use. The collecting reservoir 28 simply is removed as necessary and emptied into the toilet. The storage housing 26 of the Drain Cleaning Device 10 is suitable for placement next to the toilet, keeping the Drain Cleaning Device 10 largely out of sight, but ready and accessible.

The Drain Cleaning Device 10 of the present invention is a high quality plunger head 20 in which is concealed a rotary driven, hard rubber conical terminal fitting 22 that, when pressed downward into a clogged toilet and cranked in rotation, will extend down through the plunger head 20 to break up hard clogs, and thus enable the toilet to clear itself by flushing, or enable the plunger head 20 to easily push the broken matter through and clear the toilet.

Using the Drain Cleaning Device 10 of the present invention is simple and straightforward. A user places their palm of preference over the rotator handle 14 of the Drain Cleaning Device 10. With a firm grip, the user presses the plunger head 20 firmly against the bottom of the toilet bowl and over the clog. The user grips the rotator handle 14 firmly and cranks the elongated shaft 12 into rotation at whatever speed is required to break up the clog. The user then presses the plunger head 20 down firmly, forcing air and/or water into the drain increasing the atmospheric pressure on any clog. If the item(s) is dislodged, the pressurized air and/or water is free to travel throughout the rest of the piping. When force on the plunger head 20 is released, the vacuum created forces anything inside the drain to be forced upwards. The entire process is repeated as necessary to clear the broken clog. Finally, the user flushes the toilet.

The Drain Cleaning Device 10 of the present invention is constructed to first break up the clog in a drain and then force the clog through a stopped toilet. Because the hard rubber, rotary conical fitting terminal 22 is concealed within the plunger head 20, the Drain Cleaning Device 10 performs its work neatly and discreetly with no disgusting backsplash and no spread of fecal bacteria on bathroom rugs and other fixtures. The Drain Cleaning Device 10 efficiently and effectively clears clogged toilets, enabling homeowners and business employees to unclog toilets themselves rather than making emergency calls to plumbers. Durably constructed of a high quality materials, the present invention will withstand many years of continued use in the bathrooms of homes and facilities.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

The invention claimed is:

1. A drain cleaning device for cleaning and clearing a clogged drain, the drain cleaning device comprising:

an elongated shaft having a first end and a second end, the second end comprising a ball joint socket;

a rotator handle secured to the first end of the elongated shaft, the rotator handle rotating the elongated shaft in response to rotationally cranking the rotator handle;

a hollow handle sheath surrounding the elongated shaft, the handle sheath having a length that is shorter than a length of the elongated shaft by a particular measure, wherein the elongated shaft slides up and down along the length of the handle sheath by said particular measure, and rotates within the handle sheath;

a plunger head mounted on an end of the handle sheath adjacent the second end of the elongated shaft, the plunger head comprising a hollowed cone with (i) a top end adjacent to the second end of the elongated shaft and having a first diameter, and (ii) a bottom end extending below the second end of the elongated shaft and having a different second diameter that is smaller than the first diameter by one or more inches, the plunger head compressing in response to application of downward force on the handle sheath and the plunger head contacting a surface, wherein said compressing of the plunger head creates a suction force over said surface; and a conical terminal fitting with a resting position within the hollowed cone of the plunger head, the conical terminal fitting comprising a spherical ball and a solid conical protrusion extending below the spherical ball, the spherical ball mounting to the ball joint socket at the second end of the elongated shaft with the solid conical protrusion moving about the second end of the elongated shaft in response to rotation of the spherical ball within the ball joint socket, the solid conical protrusion connected to the spherical ball at a proximal end of the solid conical protrusion having a third diameter less than the second diameter of the plunger head, and extending from the proximal end as a solid cone with a narrowing diameter to a distal end having a fourth diameter that is less than the third diameter, and wherein the conical terminal fitting is movable from the resting position out of the plunger head in response to sliding the elongated shaft down along the length of the handle sheath by said measure and the third diameter of the solid conical protrusion being less than the second diameter of the plunger head.

2. The drain cleaning device of claim 1 wherein the elongated shaft is a solid metal shaft.

3. The drain cleaning device of claim 1 wherein the elongated shaft is constructed from a material selected from the group consisting of molded thermoplastic material, a carbon fiber composite material, and a polished metal material.

4. The drain cleaning device of claim 1 wherein the rotator handle is substantially parallel to the elongated shaft.

5. The drain cleaning device of claim 1 and further comprising:

an intermediate handle portion between the first end of the elongated shaft and the rotator handle, the intermediate handle portion substantially perpendicular to the elongated shaft and the rotator handle such that a longitudinal axis of the elongated shaft is offset from a longitudinal axis of the rotator handle.

6. The drain cleaning device of claim 1 and further comprising:

a storage housing for receiving at least a portion of the drain cleaning device.

7. The drain cleaning device of claim 6 wherein the storage housing completely receives the plunger head and the conical terminal fitting.

8. The drain cleaning device of claim 6 and further comprising:

a collecting reservoir mounted at a base of the storage housing.

9. The drain cleaning device of claim 8 and further comprising:

a mesh layer positioned above the collecting reservoir.

10. A drain cleaning device for cleaning and clearing a clogged drain, the drain cleaning device comprising:

an elongated solid shaft having a first end and a second end;

a rotator handle secured to the first end of the elongated solid shaft, the rotator handle driving the elongated solid shaft in rotation by rotationally cranking the rotator handle, the rotator handle substantially parallel to the elongated shaft;

a hollow handle sheath surrounding the elongated solid shaft, the handle sheath allowing the elongated solid shaft to slide along a length of the handle shaft and rotate within the handle sheath;

a plunger head mounted on an end of the handle sheath adjacent the second end of the elongated solid shaft, the plunger head comprising a hollowed cone with (i) a top end adjacent to the second end of the elongated shaft and having a first diameter, and (ii) a bottom end extending below the second end of the elongated shaft and having a different second diameter that is smaller than the first diameter by one or more inches;

a conical terminal fitting with a resting position within the hollowed cone of the plunger head, the conical terminal fitting comprising (i) a first end with a solid conical rubber element, and (ii) a second end rotationally coupling to the second end of the elongated solid shaft, the solid conical rubber element comprising a proximal end with a third diameter less than the second diameter of the plunger head, and extending from the proximal end as a solid cone with a narrowing diameter to a distal end having a fourth diameter that is less than the third diameter, and wherein the conical terminal fitting is movable into and out of the plunger head; and a universal ball joint swivel connecting the second end of the conical terminal fitting to the second end of the elongated solid shaft with the conical terminal fitting moving about the second end of the elongated solid shaft in response to rotation of the second end of the conical terminal fitting within the universal ball joint swivel.

11. The drain cleaning device of claim 10 wherein the elongated solid shaft is a solid metal shaft extending a first length that is greater than a length of the hollow handle sheath.

12. The drain cleaning device of claim 10 and further comprising:

an intermediate handle portion between the first end of the elongated solid shaft and the rotator handle, the intermediate handle portion substantially perpendicular to the elongated solid shaft and the rotator handle such that a longitudinal axis of the elongated solid shaft is offset from a longitudinal axis of the rotator handle.

13. The drain cleaning device of claim 10 wherein the handle sheath extends substantially from the first end of the elongated solid shaft to the second end of the elongated solid shaft.

14. The drain cleaning device of claim 10 and further comprising:

a storage housing for receiving at least a portion of the drain cleaning device;

a collecting reservoir mounted at a base of the storage housing; and a mesh layer positioned above the collecting reservoir.

* * * * *